United States Patent [19]

Iijima et al.

[11] Patent Number: 4,588,551

[45] Date of Patent: May 13, 1986

[54] ARTICLE HAVING CAST METAL PORTION AND SINTERED METALLIC PORTION AND METHOD OF PRODUCING SAME

[75] Inventors: Takaaki Iijima, Fuji; Takeshi Nishiura, Numazu; Ryuji Inomata; Eiji Tanaka, both of Fuji; Hideaki Suzuki, Numazu, all of Japan

[73] Assignee: Nissan Motor Co., Ltd., Yokohama, Japan

[21] Appl. No.: 678,467

[22] Filed: Dec. 5, 1984

[30] Foreign Application Priority Data

Dec. 6, 1983 [JP] Japan ..... 58-229096

[51] Int. Cl.[4] ..... B22F 3/10

[52] U.S. Cl. ..... 419/2; 419/5; 419/23; 419/27; 419/28; 419/29; 419/53; 419/54; 164/314; 428/548; 428/550

[58] Field of Search ..... 419/27, 28, 8, 9, 5, 419/2, 29, 23, 53, 54; 164/314; 428/548, 550

[56] References Cited

U.S. PATENT DOCUMENTS 3,808,659 5/1974 Alger et al. ..... 419/27 X 4,412,643 11/1983 Sato et al. ..... 419/27 X

*Primary Examiner*—Stephen J. Lechert, Jr.

*Attorney, Agent, or Firm*—Schwartz, Jeffery, Schwaab, Mack, Blumenthal & Evans

[57] ABSTRACT

An article comprising a first portion which is formed porously by sintering of an alloy or cermet material and a second portion which is formed of a metal and intimately bonds to the first portion. For example, the article is a rocker arm for an automotive internal combustion engine, in which first portion is the wear-resistant tip portion and the second portion the body portion. The second portion is formed by molten metal forging, with the sintered first portion set in the mould as an insert, such that the molten metal under pressure is forced to infiltrate into the pores of the sintered first portion at least in a region contiguous to the interface between the first and second portions. This article features very high strength of the bond at the interface between the first and second portions.

13 Claims, 5 Drawing Figures

ARTICLE HAVING CAST METAL PORTION AND SINTERED METALLIC PORTION AND METHOD OF PRODUCING SAME

BACKGROUND OF THE INVENTION

This invention relates to an article, such as a machine part, having a cast metal portion and at least one sintered metallic portion which bonds closely to the cast metal portion, and to a method of producing the same. For example, this invention is embodied in a rocker arm for an internal combustion engine.

There are many kinds of machine parts which are produced fundamentally by forging or casting of a metal and are required to possess a special property such as high resistance to abrasion only in a local portion having a functional surface. With respect to automotive internal combustion engines, examples of such machine parts are the cylinders each receiving a piston therein, cam shafts having cam-follower portions and rocker arms each having a tip portion which makes rubbing contact with a cam. The inside portion of each cylinder, cam-follower portions of each cam shaft and the tip portion of each rocker arm must have excellent wear-resistant and anti-seizing properties.

In many cases a machine part of the above described category is formed entirely as a single body and then the special property portion is produced as a relatively thin surface layer by plating with a hard metal or by a surface hardening treatment such as carburizing, nitriding or quenching. However, it is not always possible to obtain a sufficiently wear-resistant surface by this method, and it is difficult to produce a desirably thick wear-resistant layer by this method. Also it is known to produce a functionally similar machine part by first forming the special property portion as a separate member by a suitable method such as a powder metallurgical technique and then forming the body portion by a suitable casting method such as die casting with the separately formed portion set in the mould as an insert. However, in the composite machine part obtained by this method the bond at the interface between the body portion and the special purpose portion is not very high because the materials of the two portions do not fuse into a blend. Therefore, it is not rare that the special property portion peels off from the cast body portion during practical use of the machine part under severe conditions.

SUMMARY OF THE INVENTION

It is an object of the present invention to provide an aritcle, such as a machine part, which has a cast metal portion and at least one sintered metallic portion bonding to the cast metal portion intimately and very strongly.

It is another object of the invention to provide a method of producing an article according to the invention.

The present invention provides an article comprising a first portion which is formed porously by sintering of a metallic material and a second portion which is formed of a metal and intimately bonds to the first portion, the second portion being formed by molten metal forging with the first portion kept in contact with the molten metal such that the pores of the first portion at least in a region contiguous to the interface between the first portion and the second portion are filled with the metal of the second portion by infiltration of the molten metal under pressure during the molten metal forging process.

In another aspect, the present invention provides a method of producing an article comprising a first portion formed of a sintered metallic material and a second portion which is formed of a metal and intimately bonds to the first portion, the method comprising the steps of forming the first portion as an independent and porous member by sintering of a metallic material, and then forming the second portion by molten metal forging by the sub-steps of setting the first portion at a predetermined location in a mould having a cavity corresponding in shape to the article to be produced, injecting a pressurized molten metal into the cavity of the mould, and allowing the molten metal in the cavity to solidify while applying a predetermined pressure to the molten metal in the cavity until solidification thereof to thereby force the molten metal to infiltrate into the pores of the first portion at least in a region contiguous to the interface between the first portion and the second portion.

Usually but not necessarily, the first portion of an article according to the invention has an exposed surface which serves as a functional surface such as a highly wear-resistant surface. An article according to the invention may comprise at least one additional first portion formed of a sintered metallic material which may be different from the material of the initially mentioned first portion. In that case, all the first portions are incorporated with the second portion by a single molten metal forging process such that the molten metal is forced to infiltrate into the pores of every first portion at least in a region contiguous to the interface between each first portion and the second portion.

In an article of the invention, the bond between the sintered first portion and the second portion is not a mere face-to-face contact of two members. The forced infiltration of the molten metal into the pores of the sintered portion during the molten metal forging process results in partial intrusion of the cast alloy phase, which provides the first portion of the article, into the sintered metallic phase of the first portion across the interface. Therefore, the bond is very intimate and very strong, and there is no fear of separation of the sintered portion from the remaining portion during practical use of the article even when the article is a machine part that makes continual rubbing motion under very severe conditions as in the case of a rocker arm for an automotive internal combustion engine, for example. The invention is applicable to a wide variety of machine parts and independently useful products.

DESCRIPTION OF THE PREFERRED EMBODIMENTS

Figure 1:
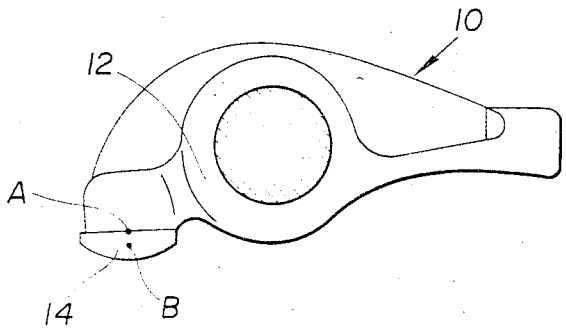
FIG. 1 is a side elevational view of a rocker arm as an embodiment of the present invention.

The first portion of a composite article according to the invention is formed of either a sintered metal, such as a ferrous sintered alloy, sintered copper alloy or sintered aluminum alloy, or a sintered cermet. A wide selection can be made from various conventional powder metallurgical materials with consideration of particular properties which the first portion is required to possess, such as resistance to abrasion, anti-seizing property, resistance to high temperatures and/or resistance to corrosion.

In any case, the sintered portion should be produced so as to have a sufficiently high porosity in order to ensure good infiltration of the molten metal into the pores of the sintered portion. It is preferred that the porosity of the first portion as sintered is not lower than 10%.

The material of the second or cast metal portion of the article can be selected from various metals and alloys that are useful in molten metal forging processes with consideration of the particular properties required to the second portion, such as mechanical strength, toughness, heat resistance and/or corrosion resistance. Aluminum, magnesium and their respective alloys are named as typical examples.

To incorporate the separately sintered first portion with the cast second portion, the first portion is set at a predetermined location in a shaping cavity in the mould of a molten metal forging machine preparatory to the molten metal forging process for forming the second portion and simultaneously completing the article. It is preferable to preheat the sintered first portion to an adequate temperature which needs not be as high as the pouring temperature in the molten metal forging process.

When the sintered portion is preheated, the sintered particles in surface regions of the sintered portion will possibly undergo air oxidation. Such oxidation of the sintered portion will possibly result in the existence of an oxide film in the completed article at the interfaces between the sintered particles in the first portion and the metal phase infiltrated into the first portion. This is unfavorable for good bonding of the first and second portions to each other. The formation of such an oxide film can be prevented by performing the preheating of the sintered portion in a reducing gas atmosphere. The preheating of the sintered portion with such care is effective for enhancement of the adhesion of the molten metal to the sintered particles.

The molten metal forging process employed in the present invention does not fundamentally differ from conventional molten metal forging processes for producing metal parts with the exception that the sintered body is set in the mould. That is, the molten metal injected into the mould is kept pressurized until solidification. In this case the magnitude of the pressure is determined so as to accomplish molten metal forging and to simultaneously force the molten metal to infiltrate well into the pores of the sintered body. It is necessary to realize such infiltration of the molten metal at least in a surface region of the sintered portion contiguous to the interface between the first portion and the second portion. When the sintered first portion is a relatively thin portion it is possible to accomplish infiltration of the pressurized molten metal into the pores in the entire regions of the first portion.

EXAMPLE

The composite machine part produced in this example was a rocker arm for an automotive internal combustion engine. FIG. 1 shows this rocker arm 10. A body portion 12 of the rocker arm 10 was a cast portion, and a tip portion 14 was a sintered portion.

Initially, the rocker arm tip 14 was formed as a separate part in the following way. First a powder mixture consisting essentially of 1.5 wt % of C, 0.5 wt % of Cu and the balance of Fe was prepared by using 100–325 mesh (Tyler's standard) powders of raw materials, and small amounts of usual compacting aids and sintering aids were added. The resultant powder mixture was compacted into the shape of the rocker arm tip 14 under a compression load of 5000 kgf/cm$^2$. The compacted material was sintered by heating at 1140° C. for 40 min. The ferrous sintered body to serve as the rocker arm tip 14 was about 20 mm×20 mm in width and about 10 mm in thickness. The density of the sintered body was about 5.7 g/cm$^3$, and the porosity was about 18%.

Figure 2:
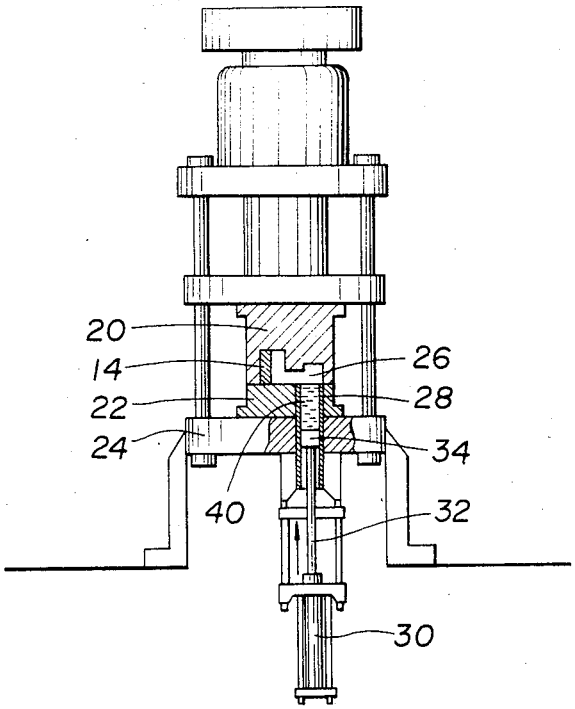
FIG. 2 is a schematic and partly sectional elevational view of a molten metal forging machine.

FIG. 2 shows a molten metal forging apparatus used in this example. The apparatus has an upper die block 20 which is movable upward and downward and a lower die block 22 fixed to a bed 24. The upper die block 20 is recessed so as to provide a die cavity 26 having the shape of the rocker arm 10 when brought into contact with the lower die block 22. A cylinder 28 is embedded in the bed 24 and lower die block 22, and a hydraulic cylinder 30 for injection of molten metal is arranged such that a plunger tip 34 at the end of a cylinder rod 32 is slidable in the cylinder 28 upward and downward.

The sintered rocker arm tip 14 was preheated to about 250° C. in a reducing gas atmosphere and suitably disposed in the cavity 26 of the molten metal forging apparatus. The material for the rocker arm body 12 was an aluminum alloy for the die casting (ADC 12 according to JIS H 5302), which consists of 1.5–3.5 wt % of Cu, 10.5–12.0 wt % of Si and the balance of Al and inevitable impurities. As shown in FIG. 2, the cylinder 28 was filled with molten metal 40 of the aluminum alloy. By the action of the hydraulic cylinder 30 the molten metal 40 was injected into the die cavity 26 in which the sintered rocker arm tip 14 was set in advance. At the time of injection the temperature of the molten metal 40 was 760° C., and the molten metal 40 was injected under a pressure of 800 kgf/cm$^2$ and at an injection speed of 50 mm/sec. To accomplish molten metal forging, the molten metal injected into the die cavity 28 was kept pressurized at 800 kgf/cm$^2$ until solidification.

Figure 3:
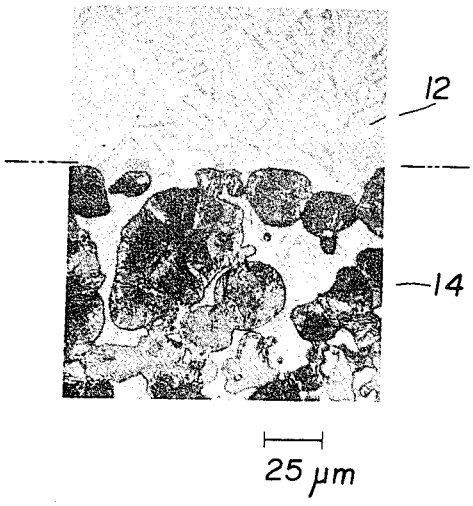
FIGS. 3 and 4 are micrographs showing the metal structure of the rocker arm of FIG. 1 produced in the Example of the invention at locations A and B in FIG. 1, respectively.
Figure 4:
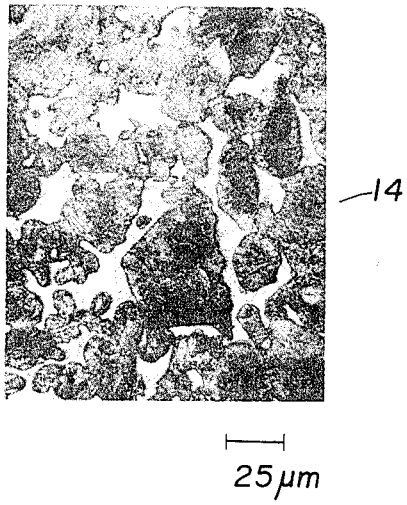

In the thus produced rocker arm 10, the sintered tip portion 14 bonded to the cast body portion 12 closely and firmly. The rocker arm 10 was cut across the interface between the cast body portion 12 and the sintered tip portion 14 to examine the bond between the two portions and the manner of infiltration of the aluminum alloy into the ferrous sintered body 14 by a usual metallographical method. FIG. 3 is a micrograph (400X) of a section across the aforementioned interface at location A in FIG. 1. FIG. 4 is a micrograph (400X) of a section at location B in FIG. 1 in a central interior region of the sintered tip portion 14. As can be seen in these micrographs, the sintered portion 14 (black areas) were well impregnated with the aluminum alloy (white areas) not only in the interface region contiguous to the cast body portion 12 but also in the central region at a distance of nearly 5 mm from the interface. Moreover, dendrites were observed in the aluminum alloy infiltrated into the sintered portion 14 as an indication of very good run of the molten alloy in the pores of the sintered portion 14. Accordingly the strength of bond between the cast portion 12 and the sintered portion 14 was very high, so that peel-off of the tip portion 14 was practically improbable in the case of this composite rocker arm tip 10.

COMPARATIVE EXAMPLE

The ferrous tip portion 14 of the rocker arm 10 was produced by the sintering method described in the foregoing Example. In this case, use was made of a die casting machine formed with a die cavity of the same shape as the cavity 26 in the molten metal forging apparatus of FIG. 2. After setting of the sintered rocker arm tip 14 in the die cavity, die casting was performed by injecting molten metal of the aluminum alloy ADC 12 at an injection pressure of 1000 kg/cm$^2$ to obtain a rocker arm 10 of the shape shown in FIG. 1.

Figure 5:
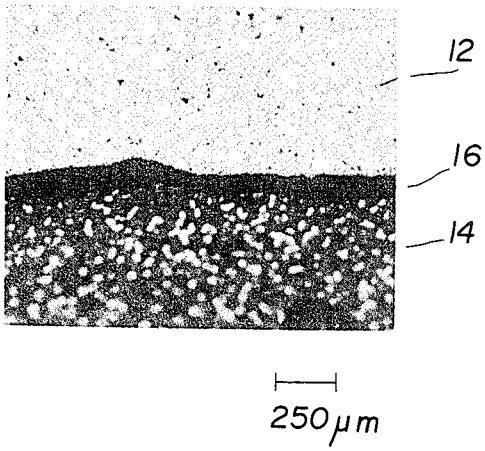
FIG. 5 is a micrograph showing the metal structure of the rocker arm of FIG. 1 produced in the Comparative Example at location A in FIG. 1.

FIG. 5 is a micrograph (40X) of a section across the interface between the cast portion 12 and the sintered portion 14 of the thus produced rocker arm 10. In this case, a gap (black band 16 in the micrograph) was observed at the interface, and the bond between the two portions 12 and 14 was confirmed to be inferior. The micrograph shows the presence of white areas in the sintered portion 14. By an etching test, the whitely appearing substance was confirmed not to be the aluminum alloy. This substance was presumed to be the residue of a resinous additive contained in the sintered material.

What is claimed is:

1. An article comprising:

a first portion which is formed porously by sintering of a metallic material: and a second portion which is formed of a metal and intimately bonds to said first portion, said second portion being formed by molten metal forging with said first portion kept in contact with the molten metal such that the pores of said first portion at least in a region contiguous to the interface between said first portion and said second portion are filled with said metal of said second portion by infiltration of the molten metal under pressure during the molten metal forging process.

2. An article according to claim 1, wherein said first portion has an exposed surface.

3. An article according to claim 1, wherein the porosity of said first portion before bonding with said second portion is not lower than 10%.

4. An article according to claim 1, wherein said first portion is formed of a sintered metal.

5. An article according to claim 1, wherein said firt portion is formed of a sintered cermet.

6. An article according to claim 1, wherein said metal of said second portion is selected from the group consisting of aluminum, aluminum alloys, magnesium and magnesium alloys.

7. A method of producing an article comprising a first portion formed of a sintered metallic material and a second portion which is formed of a metal and intimately bonds to said first portion, the method comprising the steps of:

(a) forming said first portion as an independent and porous member by sintering of a metallic material; and (b) forming said second portion by molten metal forging by the sub-steps of setting said first portion formed at step (a) at a predetermined location in a mould having a cavity corresponding in shape to the article to be produced, injecting a pressurized molten metal into said cavity of said mould, and allowing the molten metal in said cavity to solidify while applying a predetermined pressure to the molten metal in said cavity until solidification thereof to thereby force the molten metal to infiltrate into the pores of said first portion at least in a region contiguous to the interface between said first portion and said second portion.

8. A method according to claim 7, wherein the location of said first portion in said cavity is such that in the produced article said first portion has an exposed surface.

9. A method according to claim 7, wherein the porosity of said first portion formed at step (a) is not lower than 10%.

10. A method according to claim 7, further comprising the step of preheating said first portion prior to step (b).

11. A method according to claim 10, wherein said first portion is preheated in a reducing gas atmosphere.

12. A method according to claim 7, wherein said metallic material in step (a) is a material for a sintered metal.

13. A method according to claim 7, wherein said metallic material in step (a) is a material for a sintered cermet.

* * * * *